US005107994A

United States Patent [19]

Karls

[11] Patent Number: 5,107,994

[45] Date of Patent: Apr. 28, 1992

[54] CHART HOLDER

[76] Inventor: James H. Karls, 900 N. Glenayre Dr., Glenview, Ill. 60025

[21] Appl. No.: 527,432

[22] Filed: May 23, 1990

[51] Int. Cl.[5] ..... A47F 7/00

[52] U.S. Cl. ..... 211/45; 248/176; 294/159

[58] Field of Search ..... 248/176; 211/45, 46, 211/47, 48; 294/138, 143, 159

[56] References Cited

U.S. PATENT DOCUMENTS

| | | | |
|---|---|---|---|
| Re. 20,459 | 8/1937 | Best | 211/45 |
| 354,208 | 12/1886 | O'Sullivan | 211/45 |
| 466,727 | 1/1892 | Reading | 211/45 |
| 819,989 | 5/1906 | Gilbert | 211/48 |
| 1,280,174 | 10/1918 | Dancer | 211/45 |
| 1,404,240 | 1/1922 | Shupe | 211/45 X |
| 1,654,341 | 12/1927 | Mendiolagoitia | 211/45 X |
| 2,546,600 | 3/1951 | Holden | 211/45 X |
| 4,697,710 | 10/1987 | Gradecki et al. | 211/45 |
| 4,948,202 | 8/1990 | Helseth | 211/45 X |

FOREIGN PATENT DOCUMENTS

| | | | |
|---|---|---|---|
| 1431877 | 2/1966 | France | 211/48 |

*Primary Examiner*—David L. Talbott
*Attorney, Agent, or Firm*—Gerstman & Ellis, Ltd.

[57] ABSTRACT

A holder for positioning and displaying charts. The holder comprises a hand-holdable board member, the board member defining at least one and preferably a plurality of generally parallel slot pairs extending therethrough. The slot pairs may be defined by separate slots, or alternatively one or more rollers carried in an aperture formed in the board member to define the respective slots of a pair between opposed roller sides and the wall of the aperture. Accordingly, an individual paper chart can be placed to extend through individual slots of a pair, being wrapped about the roller if present, to place a portion of the chart on one side of the board member with the remainder of the chart positioned in the slots and on the other side of the board member. By this means, several charts may be carried in one hand in a regular array, and portions of the charts may be presented for view, while the remainder of the charts is out of the way, but available for such viewing.

20 Claims, 1 Drawing Sheet

CHART HOLDER

BACKGROUND OF THE INVENTION

The chart holder of this invention is for positioning and displaying preferably a plurality of charts in the hand, while keeping the charts positioned in a desired manner for ready reference.

In the exchanges for the trading of stocks, commodities, and various options, the traders on the exchange floors generally must carry in their hands a number of charts which typically relate to appropriate transaction prices, depending upon the strike price of options, the price of the basic stock or commodity in question, the current price of the option, and the like Frequently, a trader must hold three or more of such charts in his hand, while referring constantly to a particular horizontal line portion of each individual chart which may vary from moment to moment as, for example, the price of an option, a stock, or a commodity varies. This all is accomplished by the trader while standing on his feet in an often boisterous crowd of fellow traders, with constant jostling and pushing going on.

In accordance with this invention, a convenient and effective holder for positioning and displaying preferably a plurality of charts is provided. The charts may be held so that only a particular linear area of the chart is displayed to the user, but any of the charts may be quickly adjusted for presentation of another linear area thereof as required by changing circumstances.

The entire plurality of charts may be held in a single, hand-holdable member, so that only the immediate, pertinent data is presented to the user from any of a plurality of charts, sometimes from three charts up to six or eight simultaneously, if desired.

DESCRIPTION OF THE INVENTION

In this invention, a holder for positioning and displaying preferably a plurality of charts is provided, which comprises a hand-holdable board member, which is preferably a flat plate made of plastic or the like. The board member defines at least one, and preferably a plurality, of parallel slot pairs extending therethrough.

Thus, individual paper charts can each be placed to extend through individual slots of a pair in opposite directions. This places a portion of the chart on one side of the board member, with the remainder of the same chart positioned in the slots and on the other side of the board member. Hence, the user of the invention may carry several charts in the one board member, where only a portion of each chart, such as a few lines or the like, is presented to the user at any one time, to assist him in focusing his immediate attention upon the critical sections of the various charts thus presented to him.

As desired, the charts may be quickly and easily adjusted through the slots to place different sections thereof on the one side of the board member as circumstances change. Thus, if the price of a commodity or option changes, the user can simply slide the appropriate chart through the pair of slots to a new line on the chart which relates to the new price. By this technique, the immediate, pertinent data on the charts can be presented to the user without the user having to stop to find the appropriate line or the like, while the remainder of the charts remain out of view, but ready for presentation at any moment as required by changing circumstances.

It may be desired for the holder of this invention to carry a shield member on the other side of the board member, to at least partly enclose the remainder of the charts which are positioned on the other side of the board member. Thus, the remainder of the charts can be better protected.

Also, if desired, the holder of this invention may carry means for attachment to another holder of similar design. Thus, the holder of this invention may be modular, with sections being snapped together to accommodate the desired number of charts in a single, hand holdable array in which only the desired, selected sections of each chart are presented at any given moment to the user.

It is also desirable for the individual slot pairs defined by the board member of this invention to be each defined by roller member means carried in an aperture formed in the board member. By this means the respective slots of a pair are defined between opposed roller sides and the wall of the aperture, rather in the manner of a typewriter roller sitting in a closely fitting slot in the top of a typewriter.

Thus, an individual paper chart can be placed to extend through individual slots of a pair while wrapped about the roller member means. The effect of this is to place a portion of the chart on one side of the board member, with the remainder of the chart positioned in the slots and on the other side of the board member, as previously described, while being easily movable by rolling of the roller.

While it may be preferred for the roller member means to comprise a single roller, the roller member means may also comprise a pair of rollers carried in parallel, adjacent relation in the aperture. One advantage of such use of a pair of rollers is that much of the portion of the chart presented to the user on the one side of the board member may be relatively flat, when compared with the corresponding chart configuration provided by a single roller.

Thus, the trader, or others in similar situations who must work on their feet with much data, is provided by this invention with a means for organizing and presenting data into a simple, hand-holdable form, where it may be easily viewed for on the spot calculations and decisions. The invention of this application finds use not only in the field of trading on exchange floors, but in other activities such as athletic coaching, military operations in the field, and other operations where a desk cannot be used.

DESCRIPTION OF SPECIFIC EMBODIMENTS

Figure 1:
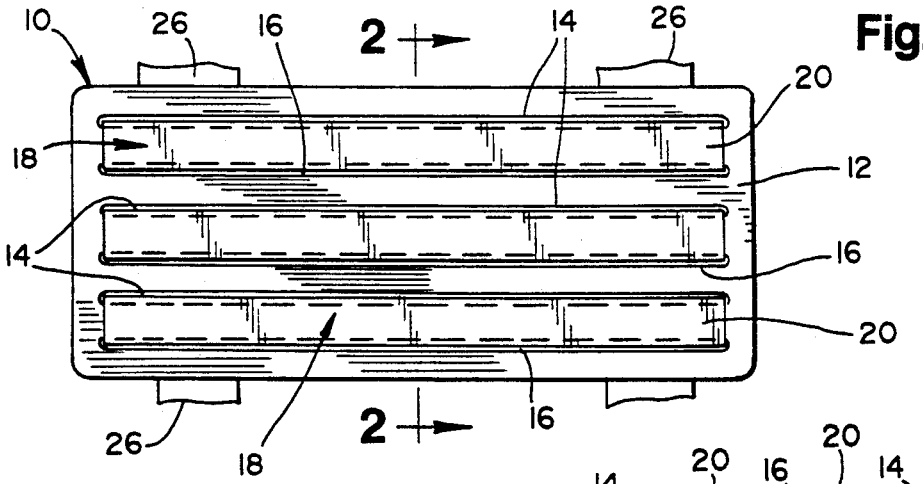
FIG. 1 is a plan view of the holder of this invention for positioning and displaying charts.
Figure 2:
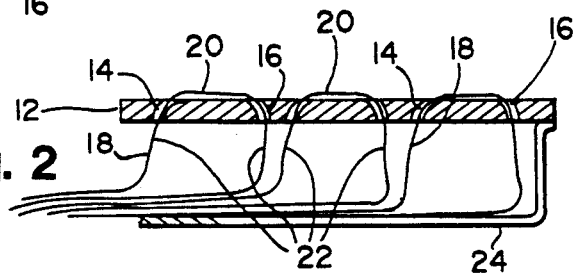
FIG. 2 is a sectional view taken along line 2—2 of FIG. 1.

Referring to FIGS. 1 and 2, holder 10 comprises a flat, hand holdable plastic board which may be wide enough to accommodate the desired charts, which for example may be standard 8½ width papers or the like. Plastic board 12 may be made of rigid, reinforced polystyrene or the like, a plastic laminate, or alternatively, it may be made of wood, aluminum, or the like.

As shown, board member 12 defines a plurality of parallel slot pairs 14, 16, which are preferably relatively narrow so as to snugly receive a piece of paper 18 as the chart described above. As shown, the individual paper charts 18 are placed to each extend through the respective slots 14, 16 in opposite directions, in that the paper 18 is threaded, for example, to extend upwardly through slot 16 as shown and then downwardly through its companion slot 14, to place a portion 20 of the chart on one side of the board member, with the remainder 22 of the chart being positioned in the slots and on the other side of the board member, as particularly shown in FIG. 2. Thus, as seen from the viewpoint of FIG. 1, which is the way the user will view the chart, only portion 20 of the chart will be visible to the user. However, when the user needs to view another portion of the chart, he can easily slide any of the individual charts, by the use of his thumbs, through the respective slots 14, 16 to expose a new portion 20 of the chart to view, while the remainder 22 of the chart is safely stored underneath board 12.

If desired, a shield member 24 may be provided, being carried on the underside of board member 12 in its position of use as shown in FIG. 2, to at least partly enclose and protect the portions 22 of the respective charts 18. Alternatively, shield member 24 may be deleted for a simplified holder in accordance with this invention.

Additionally, snap-fit members 26 or other attachment means may be provided to board 12, so that two or more of the respective holders can rigidly snap together into a single unit. Thus, by this invention, the holder shown in FIG. 1 may be attached to another holder of the same type to provide display room for six charts rather than three charts in a hand-held, composite holder system.

If desired, board member 12 may be curved rather than flat, as shown, to provide a design for easy holding.

Figure 3:
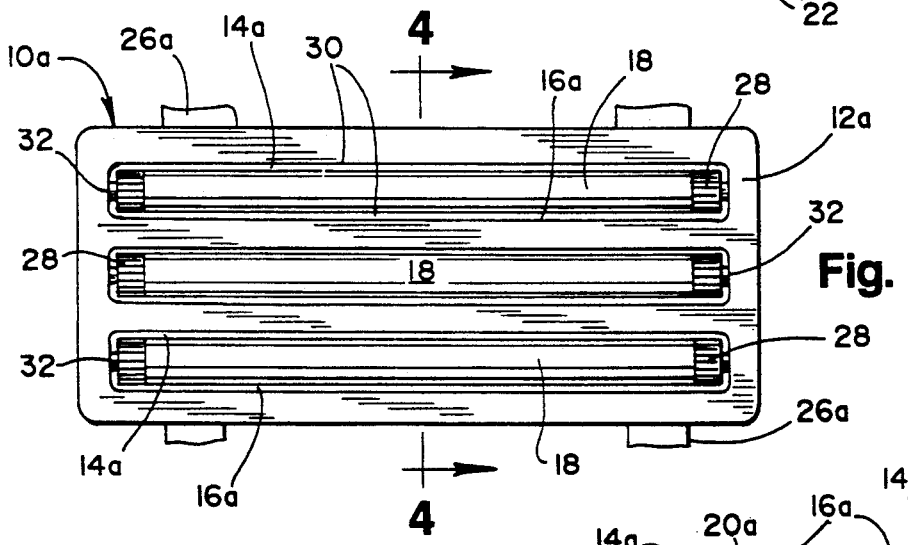
FIG. 3 is a plan view of another embodiment of the holder of this invention for positioning and displaying charts.
Figure 4:
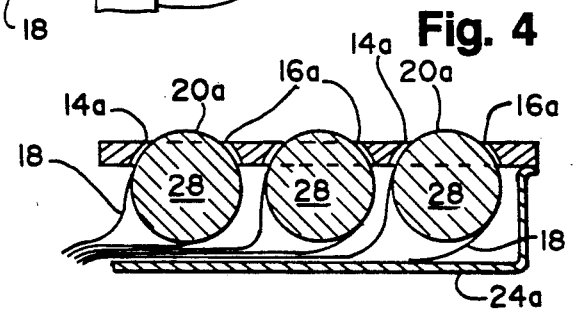
FIG. 4 is a sectional view taken along line 4—4 of FIG. 3.

Referring to FIGS. 3 and 4, another embodiment of the invention is disclosed.

As in the first embodiment, holder 10*a* comprises a board member 12*a*, the entire system being similar to that described in the previous embodiment except as otherwise indicated herein.

In this embodiment, the generally parallel slot pairs, each comprising slots 14*a*, 16*a*, are each defined by a roller member 28 which is carried in an aperture formed in the board member. The roller member occupies most of the aperture except for opposed edge portions thereof which define the respective slots 14*a*, 16*a* in conjunction with the walls of board member 12*a* that define the apertures. Also, if desired, roller members 28 may be made of a flexible, high friction material. Rollers 28 may gently touch slot-defining edges 30 defined by board 12*a*, so that roller 28 can deform slightly to permit the passage of a piece of paper 18 (FIG. 4) through the respective slots 14*a*, 16*a*.

Thus, the paper charts 18 may be placed into this embodiment of holder 10*a* in a manner quite analogous to that of the previous embodiment, with the paper extending upwardly through slot 16*a* and downwardly again through slot 14*a* in each case to place a desired portion 20*a* of chart 18 on one side of the board member with the remainder of the chart being positioned in the slots and on the other side of the board member, as in the previous embodiment. However, in this instance, the presence of rollers 28 greatly facilitate the loading of charts 18 into the slots and their adjustment from time to time as needed during use. To facilitate this, it is generally preferred for rollers 28 to be wider than the individual charts 22 that they carry as shown in FIG. 3, so that one may roll the rollers 28 with one or both thumbs with ease, moving the carried chart 18 along with the roller as desired.

Rollers 28 may be conventionally mounted on a spindle or axle 32 at each end, which rotates in a conventional socket carried by plate 12*a*.

As before, an optional shield member 24*a* may be provided to protect and partially enclose the remainder of the charts which are positioned on the other side of the board member.

Snap fit attachment member 26*a* may also be carried by board 12*a* for linkage of two or more of such boards together if desired, for the reasons described above.

Figure 5:
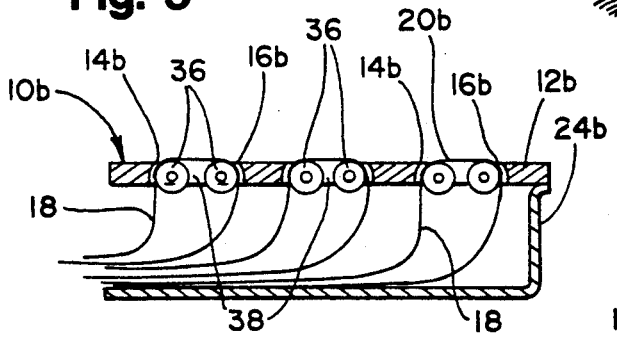
FIG. 5 is a sectional view similar to FIG. 4 but showing a modification of the invention.

FIG. 5 shows a third embodiment of the holder of this invention, which particularly represents a modification of the device of FIGS. 3 and 4.

Holder 10*b* includes a board 12*b* of similar construction to the previous boards, which define pairs of slots 14*b*, 16*b* having the paper-holding function as previously described. However, in this particular embodiment, a pair of rollers 36 are provided in each of the apertures defined in board 12*b*. Rollers 36 are positioned in parallel, adjacent relation in each aperture to define the respective slots 14*b*, 16*b* between each roller at opposite sides and the aperture wall of board 12*b*. Accordingly, the portions 20*b* of paper charts 18 which are presented to the user on the one side of board member 12*b* can be relatively flat, when compared with portions 20*a* of the previous embodiment.

Apart from the above the embodiment of FIG. 5 may be substantially identical to the embodiment of FIGS. 3 and 4. A shield member 24*b* may be carried if desired in accordance with the previous embodiment, or member 24*b* may be omitted for a simplified device.

Figure 6:
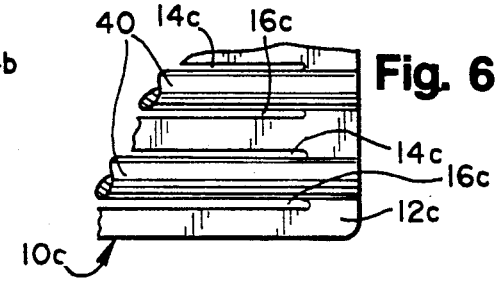
FIG. 6 is a fragmentary plan view of another embodiment of the holder of this invention for positioning and displaying charts.

Referring to FIG. 6, a simplified one-piece holder may be provided which exhibits advantages similar to the holder of FIG. 3. However, in this embodiment 10*c* of the holder of this invention, board 12*c* may be made of molded plastic or the like, carrying a plurality of integral, cylindrical portions 40 which extend outwardly from both sides of board 12*c* in a manner somewhat similar to rollers 28 of the embodiment of FIGS. 3 and 4, except that cylindrical portions 40 may be affixed, stationary, integral parts of board 12*c*. Also portions 40 may be made of a low friction material to permit charts to slide along the portions.

Slots 14*c*, 16*c* may be respectively defined on opposed sides of each cylindrical portion 40 to serve a function similar to the respective slots 14*c*, 16*c* of the previous embodiments.

The holder 10*c* disclosed in FIG. 6 may function in a manner similar to the previous embodiments, while it may have no moving parts, and may be thus manufactured with a simplified method. The cylindrical portions 40 provide a curved surface across which the desired charts may extend as they pass into and out of the respective slots 14c, 16c in the manner similar to that described with respect to the previous embodiments, with the added advantage that the charts are less likely to become creased, as may take place in the embodiment of FIGS. 1 and 2, while the simplified device of FIG. 6 is without moving parts.

Alternatively, integral portions 40 may be arcuate, but other than cylindrical in shape. Particularly, it may be desired for portions 40 to be semi-circular or D-shaped in cross section, with the flat side of the respective portions 40 being approximately flush with the surface of board 12c opposed to the surface shown in FIG. 6. However, as before, portions 40 in such an embodiment present a cylindrical surface on the side shown in FIG. 6.

Thus, the invention of this application provides a holder for organizing charts of any type, which is to say any papers which carry information or data, for the use of those who must be on their feet while making decisions and calculations. This invention provides a system where the relevant information from a plurality of charts may be organized and held in the hand for easy reference of selected areas of the chart.

The above has been offered for illustrative purposes only, and is not intended to limit the scope of this invention of this application, which is as defined in the claims below.

That which is claimed is:

1. A holder for positioning and displaying charts, which comprises:

a hand-holdable board member, said board member defining at least one generally parallel slot pair extending therethrough, and a chart placed to extend through individual slots of the pair in opposite directions, to place a portion of said chart on one side of the board member for display, with the remainder of said chart positioned in the slots and on the other side of the board member, the width of each slot of said pair being less than the distance between the slots of said pair.

2. The holder of claim 1 in which said holder carries a shield member on the other side of the board member to at least partly enclose the remainder of said charts.

3. The holder of claim 1 in which said board member comprises a flat plastic piece.

4. The holder of claim 1 which carries means for attachment to another holder of similar design.

5. The holder of claim 1 which defines a plurality of said generally parallel slot pairs, said slot pairs carrying a plurality of charts.

6. The holder of claim 1 in which said board member defines an arcuate member positioned between generally parallel slot pairs to define an outwardly facing, substantially cylindrical surface between said slot pairs.

7. The holder of claim 6 in which said arcuate member is generally cylindrical in shape.

8. The holder of claim 6 in which said arcuate member is rigidly affixed to said board member.

9. The holder of claim 1 in which said generally parallel slot pair defines slot cross sections through said board member in which said slot cross sections of the pair incline toward each other in the direction of said one side.

10. A holder for positioning and displaying a plurality of charts, which comprises:

a hand-holdable board member, said board member defining at least one generally parallel slot pair extending therethrough, said slot pair being defined by roller member means carried in an aperture formed in said board member to define the respective slots of a pair between opposed roller sides and the wall of said aperture, and a chart placed to extend through individual slots of the pair while wrapped about said roller member means, to place a portion of said chart on one side of the board member for display, with the remainder of said chart positioned in the slots and on the other side of the board member.

11. The holder of claim 10 in which said roller member means comprises a single roller positioned in said aperture.

12. The holder of claim 10 in which said roller member means comprises a pair of rollers carried in parallel, adjacent relation in said aperture.

13. The holder of claim 10 in which said holder carries a shield member on the other side of the board member to at least partly enclose the remainder of said charts.

14. The holder of claim 10 in which said board member comprises a flat plastic piece.

15. The holder of claim 10 which carries means for attachment to another holder of similar design.

16. The holder of claim 10 which defines a plurality of said generally parallel slot pairs defined by a plurality of roller member means in a plurality of said apertures, said slot pairs carrying a plurality of charts.

17. The holder of claim 10 in which said generally parallel slot pair defines slot cross sections through said board member in which said slot cross sections of the pair incline toward each other in the direction of said one side.

18. A holder for positioning and displaying a plurality of charts, which comprises:

a hand-holdable, first plastic board member, said board member defining a plurality of parallel slot pairs extending therethrough, said slot pairs being each defined by a roller carried in an aperture formed in said board member to define the respective slots of a pair between opposed roller sides and the wall of said aperture, and charts respectively placed to extend through individual slots of a pair while wrapped about said roller to place a portion of each chart on one side of the board member with the remainder of said charts positioned in the slots and on the other side of the board member.

19. The holder of claim 18 which carries means for attachment to another holder of similar design.

20. The holder of claim 18 in which said generally parallel slot pairs each define slot cross sections through said board member in which said slot cross sections of each pair incline toward each other in the direction of said one side.

* * * * *